United States Patent [19]

Von Hagen

[11] Patent Number: 4,594,957

[45] Date of Patent: Jun. 17, 1986

[54] SEWING MACHINE BELT FEED WITH VARIABLE PITCH DRIVE PULLEY

[75] Inventor: Wolf R. Von Hagen, Hemmingen, Fed. Rep. of Germany

[73] Assignee: Union Special GmbH, Stuttgart, Fed. Rep. of Germany

[21] Appl. No.: 678,727

[22] Filed: Dec. 5, 1984

[30] Foreign Application Priority Data

Dec. 10, 1983 [DE] Fed. Rep. of Germany ..... 3344761

[51] Int. Cl.[4] ..... D05B 27/04

[52] U.S. Cl. ..... 112/304; 112/314; 474/49; 474/54; 271/270

[58] Field of Search ..... 474/46, 47, 49, 50, 474/52, 53, 54, 55, 56, 57; 112/304, 314; 226/170–172, 175, 178; 271/270, 202; 198/835

[56] References Cited

U.S. PATENT DOCUMENTS

| | | | |
|---|---|---|---|
| 2,782,649 | 2/1957 | Shortland | 474/47 |
| 4,417,535 | 11/1983 | Hannemann | 112/304 |

FOREIGN PATENT DOCUMENTS

| | | | |
|---|---|---|---|
| 2828524 | 1/1980 | Fed. Rep. of Germany | 474/49 |
| 648662 | 12/1928 | France | 474/54 |
| 7048 | of 1914 | United Kingdom | 474/46 |
| 389251 | 3/1933 | United Kingdom | 474/54 |

*Primary Examiner*—Werner H. Schroeder
*Assistant Examiner*—Andrew M. Falik
*Attorney, Agent, or Firm*—John A. Schaerli

[57] ABSTRACT

A work advancing mechanism for a sewing machine which includes a driven circulatory belt for positively advancing the work beneath the presser foot of the machine. The belt is entrained about and driven by a wheel assembly having an adjustable operative circumference for modulating the lineal advancement rate of the belt.

2 Claims, 5 Drawing Figures

FIG. 1
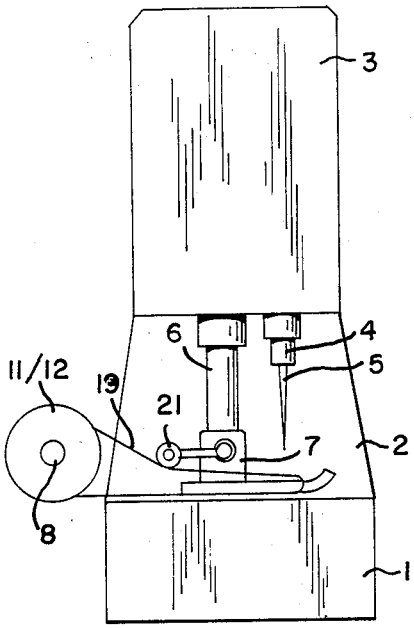
FIG. 2
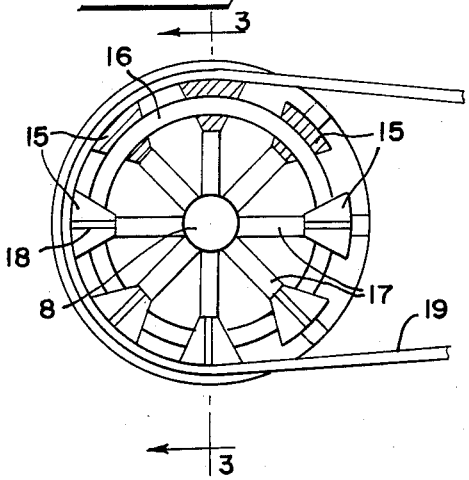
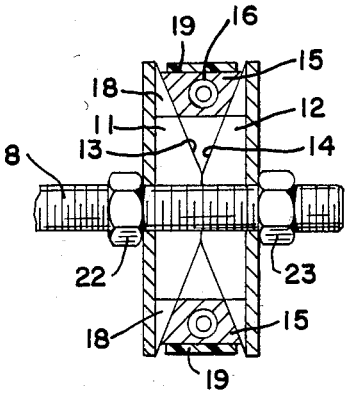
FIG. 3
FIG. 5
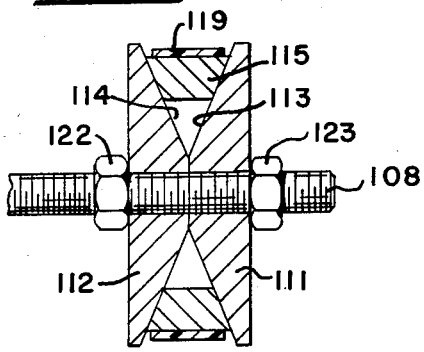
FIG. 4
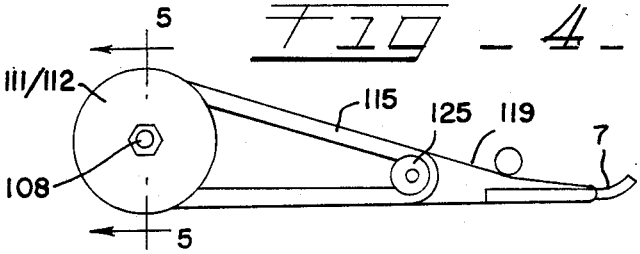

SEWING MACHINE BELT FEED WITH VARIABLE PITCH DRIVE PULLEY

FIELD OF THE INVENTION

This invention relates to sewing machines and, more particularly, it has reference to a sewing machine having a top feed mechanism for advancing the work beneath the presser foot of the machine.

BACKGROUND OF THE INVENTION

As is exemplified in German Patent Application No. P 24 26 538, sewing machines having belt drives are known in the art. In this German Patent Application, the belt is driven by an intermittently rotating shaft which, in turn, is driven by an overrunning clutch mechanism. With such a drive, the feed rate is adjusted by changing the deflection or swing of the overrunning clutch. An inherent drawback with such mechanisms is the inconsist amount of overthrow. That is, at different sewing speeds there are different amounts of overthrow and, accordingly, different amounts of belt advancement resulting in a nonuniform workpiece feed.

German Patent Application No. P 28 48 123 illustrates another form of feed belt mechanism. This application discloses a continuously driven belt, the speed of which is variable. A series of gears and belts are employed for effecting this end. The gearing for changing the feed rate is complicated and thus, understandably, expensive to manufacture. Albeit the variable friction drive of the type disclosed is constant, this type of drive does not permit slippage between the work and the feed belt. Therefore, a gear system of the type disclosed is not applicable for intermittently moving a workpiece past a sewing instrumentality.

U.S. Pat. No. 3,435,790 to A. N. Hale is exemplary of a sewing machine device having an intermittent rotating drive shaft. Because of the form of locking connection disclosed in this device, there generally is no overthrow of the driving means. Such structure, however, permits only limited adjustability of the output.

BRIEF DESCRIPTION OF THE PRESENT INVENTION

Because of the foregoing, and in accordance with the present invention, there is provided a work advanced mechanism which solves many of the heretofore mentioned drawbacks associated with other sewing devices. Like the other feed mechanisms, the present invention includes a relatively thin flexible belt disposed in the form of a closed loop, a portion of which extends beneath the presser foot sole of the machine. The continuous belt partially envelopes a driven wheel assembly which imparts longitudinal motion to the belt. The wheel assembly is disposed remote from the sewing area of the machine and includes a power shaft on which a pair of mutually adjustable discs are threadably arranged. The power shaft may be driven intermittently or continuously depending upon the particular sewing operation being performed. The interfaces of the discs are tapered to define a wedge shaped or cuneiform recess. Radially adjustable bearing or support means for the feed belt are accomodated in the recess.

As will be appreciated, axial shifting of the discs relative each other results in radial displacement of the belt support means relative to the axis of the drive shaft. Accordingly, a change in the operative circumference of the wheel assembly is effected. Of course, any change in the operative circumference of the wheel assembly will directly affect the lineal speed of the belt entrained thereabout. Moreover, because the driven belt is relatively thin and therefore of little weight, movement of same may be effected without slippage during intermittent or continuous operation.

In line with the above, a primary object of the present invention is the provision of a positive feed mechanism which can be continuously or intermittently operated and whose speed may be readily modulated.

Another object of the present invention is to provide a belt feed mechanism for a sewing machine wherein the feed advancement rate may be readily changed without requiring part replacement.

Another object of this invention is to provide a feed mechanism for a sewing machine which is efficient and economical to manufacture.

BRIEF DESCRIPTION OF DRAWINGS

Having in mind the above objects and other attendent advantages that will be evident from an understanding of this disclosure, the invention comprises the devices, combinations, and arrangement of parts as illustrated in the presently preferred embodiments of the invention which are hereinafter set forth in detail to enable those skilled in the art to readily understand the functions, operation, construction and advantages of it when read in conjunction with the accompanying drawings in which:

FIG. 1 is a schematic end view of a sewing machine incorporating the present invention;

FIG. 2 is an enlarged end view, partly in section, of the drive wheel assembly of the present invention;

FIG. 3 is a sectional view taken along line 3—3 of FIG. 2;

FIG. 4 is a schematic end view of a second embodiment illustrating the present invention; and FIG. 5 is a sectional view taken along line 5—5 of FIG. 4.

DETAILED DESCRIPTION OF THE PRESENT INVENTION

Referring now the drawings, wherein like reference numerals indicate like parts throughout the several views, in FIG. 1 there is shown a sewing machine. The machine chosen for convenience of illustrating the invention includes a bed or work support 1 having a generally horizontal work supporting surface. From one end of the work support 1 a standard 2 rises to support an overhanging bracket arm. In the usual manner, the bracket arm terminates in a head portion 3. The head portion 3 supports therein for endwise reciprocation in the usual manner a needle bar 4 to the end of which is affixed a sewing needle 5 defining a stitch forming or sewing area. Supported in the head portion 3 behind the needle bar (in the direction of workpiece advancement) is a presser bar 6. A presser foot assembly 7 is affixed in the usual manner to the distal end of the presser bar 6.

Arranged in combination with the sewing machine, there is provided a unique work advancing mechanism which is the subject of this patent application. The input power for the work advancing mechanism is derived from a power shaft 8. As seen in FIG. 1, the shaft 8 is disposed behind the sewing area with its longitudinal axis extending generally parallel to the work supporting surface of the machine. The shaft 8 may be continuously or intermittently driven by any suitable means and in synchronization with the machine operation. Adjustably arranged upon the shaft 8 is a rotatably driven wheel assembly or sheave means. As best seen in FIG. 3, the wheel assembly means includes a pair of complimentary discs 11 and 12 which are coaxially and threadably arranged on the shaft 8. The discs 11 and 12 are mutually adjustable toward and away from each other. Moreover, the discs 11 and 12 have tapering inner surfaces 13 and 14, respectively, which may overlap one another and which define a wedge shaped or cuneiform recess. A plurality of radially adjustable bearings or support members 15 are accomodated in the recess. An expansible ring 16, for example a spiral spring, is operatively associated with the ring elements 15 and serves to radially pull or draw the elements 15 toward the shaft 8. The elements 15 are guided in their relationship with the wheel assembly. That is, the tapering inner surfaces of the discs 11 and 12 are provided with radial channels 17 adapted to accomodate webs 18 which outwardly project from the sides of each ring element 15. At a location remote from the sewing area, a circulatory means or continuous belt like member 19 is trained for travel about the ring elements periphery. As seen in FIG. 1, the belt is led from the wheel assembly in loop form and a portion of the belt like member is adapted to pass beneath the presser foot between the presser foot sole and the work to serve as a movable work engaging surface of the presser device. The presser foot sole is appropriately slotted to permit the passage of the belt therethrough.

In practice, the belt is maintained under tension by means of a roller 21 which is carried on the distal end of the pivotal lever whose opposite end may be secured to the presser foot assembly. When necessary, due to stretch and accumulation of slack in the belt, the disposition of the roller 21 may be adjusted in a manner readily understandable from FIG. 1. Alternatively, a spring engageable with lever may be used to impart a moderate degree of tension to belt 19.

As may be readily appreciated by one skilled in the art, the operational speed of the belt 19 may be readily adjusted without part replacement. As seen in FIG. 3, the discs halves 11 and 12 are held in their adjusted position by means of fasteners 22 and 23 which are threadably arranged on the shaft 8. After releasing the fasteners 22 and 23, it is possible to axially shift the discs 11 and 12 relative to one another. As will be appreciated, the axial shifting of the discs results in radial displacement of the ring or bearing segments 15 relative to the axis of shaft 8 and thereby effecting a change in the operative circumference of the wheel assembly. Of course, any change in the operative circumference of the wheel assembly affects the lineal speed of the belt entrained thereabout.

A second embodiment of a work advancing mechanism is schematically illustrated in FIGS. 4 and 5. In this embodiment, the drive wheel assembly is driven by a power shaft 108 and includes a variable pitch V-belt sheave assembly. The variable pitch sheave assembly is comprised of complimentary disc halves 111 and 112. The disc halves 111 and 112 are provided with tapering inner surfaces 113 and 114, respectively, defining a wedge or V shaped recess. Interposed between the driven wheel assembly and the presser foot 7 is a second V belt pulley 125. Entrained about the variable pitch sheave assembly and the second pulley 125 is a V belt 115. The V belt 115 serves as a support means for a flexible work engaging belt means 119. To avoid slippage during operation, the support means 115 and the driven belt 119 are provided with intermeshing projections. As with the first embodiment, the disc halves 111 and 112 are equally adjustable on the drive shaft relative to each other. Fasteners 122 and 123 are provided for securing the disc halves in their adjusted positions.

From the foregoing it will be apparent that this invention affords an improved work advancing mechanism for sewing machines which will effectively move material, either continuously or intermittently, beneath the presser foot sole. By properly positioning the radial disposition of the belt's support means through axial displacement of the disc halves of the wheel assembly, the lineal displacement rate of the work advancing mechanism can be quickly and easily proportional to the adjusted speed of the sewing machine.

Thus there has been provided in accordance with the invention, a Work Advancing Mechanism for Sewing Machines that fully satisfies the object, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. For use in combination with a sewing machine having needle means and a presser foot defining a sewing area, a work advancing mechanism comprising:

a continuous circulatory work engaging member, a portion of which passes beneath said presser foot; and means for driving said circulatory member in synchronization with said sewing machine, said driving means including means to change the work advancing rate of said circulatory member comprising a pair of complimentary disk means each having tapering inner surface means which are each provided with radial channel means, said complimentary disk means being mutually adjustable toward and away from each other and said tapering inner surface means overlapping one another whereby defining a wedge shaped recess means; a plurality of radially adjustable bearing means accomodated with said channel means and being partially enveloped by said work engaging member at a location disposed remote from the sewing area; and a means for tensioning the work engaging member.

2. A sewing machine comprising:

a work support having a generally horizontal work supporting surface;

a needle operated from above the work support;

a presser foot operative to hold a workpiece against the work supporting surface; and work feeding means including: a continuous belt means and drive means disposed remote from the needle means for causing longitudinal motion of said belt means; said drive means including means for changing the work feed rate comprising a variable pitch V-belt pulley means having said belt means partially enveloped about the operative circumference thereof, and means for adjusting the operative circumference thereof, said belt means including a V-belt that is entrained about the variable pitch V-belt pulley means which serves as a support means for a flexible work engaging belt means a length of which runs under the presser foot.

* * * * *